United States Patent [19]

Dowd

[11] Patent Number: 4,754,963

[45] Date of Patent: Jul. 5, 1988

[54] HAND EXERCISE DEVICE

[76] Inventor: Michael E. Dowd, 825 Mead Rd., Rochester, Mich. 48064

[21] Appl. No.: 92,364

[22] Filed: Sep. 2, 1987

[51] Int. Cl.[4] ..... A63B 5/00

[52] U.S. Cl. ..... 272/67; 272/141

[58] Field of Search ..... 272/67, 68, 93, 119, 272/141, 96, 116, 117; 273/425

[56] References Cited

U.S. PATENT DOCUMENTS

| | | | |
|---|---|---|---|
| 3,265,389 | 8/1966 | Carlson | 272/68 |
| 3,730,523 | 5/1973 | McRae | 272/67 |

FOREIGN PATENT DOCUMENTS

| | | | |
|---|---|---|---|
| 550961 | 2/1943 | United Kingdom | 272/68 |
| 310667 | 2/1970 | U.S.S.R. | 272/67 |

OTHER PUBLICATIONS

DISC-GO; Foamcraft Specialties Literature.

*Primary Examiner*—Richard J. Apley
*Assistant Examiner*—S. R. Crow

[57] ABSTRACT

A hand exercising device of the type including a resilient body of a size and shape to fit within the palm area of a user's hand, the body being formed of a homogeneous and readily compressible material and including recesses formed therein to reduce the compressibility of the body, the improvement comprising members removably insertable within the recess means to alter the compressibility of the device and the insertable members being of a size and shape as to be frictionally retained in the recesses by the resilient body material.

1 Claim, 1 Drawing Sheet

HAND EXERCISE DEVICE

TECHNICAL FIELD

The present invention relates to a hand exercise device of the type which includes a resilient body of a size and shape adapted to fit within the palm area of a user's hand and which device is intended to be used to strengthen those arm and wrist controlling muscles which are affected by repeated gripping and squeezing of the fingers against a resilient object. Such devices are generally well known to those who wish to strengthen their grips for athletic purposes or when rehabilitating muscles after injuries.

The present invention is directed to such a hand exercising device wherein the resistance to compression or squeezing can be varied through the incorporation of means which are removably insertable in the exercise device as required by the user. More specifically, the present invention includes means which enables the user to gradually increase the resistance to compression in the hand exercising device.

BACKGROUND ART

The following patents typify hand exercising devices of various configurations and all including a compressible material:

| | |
|---|---|
| 2,271,164 Sullivan | 3,326,550 Melchiona |
| 3,129,939 Stock | 3,413,243 Griffin |
| 3,265,389 Carlson | 3,611,807 Brandell |

In common, none of the prior art references discloses means for varying the resistance of the exercise device to compression other than the natural resistance of the compressible material itself. By way of example, the Carlson U.S. Pat. No. 3,265,389 includes recesses and holes formed in the elastomeric material to reduce the natural resistance of the material to compression. However, once the recesses or holes are formed in the exercise device, the basic resistance of the device to compression is set and no further variation therein occurs other than due to the material itself.

DISCLOSURE OF THE INVENTION

Applicant's invention utilizes a resilient member of a size and shape adapted to fit within the palm area of the user's hand and incorporates recess means therewithin to reduce the basic compressibility of the body material. Applicant's improvement involves means removably insertable within the body recess means to alter the compressibility of the device in such a way that as the insertable means is frictionally inserted within the recess means, the resistance of the exercising device is increased. Thus, with applicant's device a user may begin an exercise program wherein the recess means are open or unfilled with any additional members and then progressively increase the resistance of the device by adding the insertable means to progressively increase resistance of the device to compression.

BEST MODE FOR CARRYING OUT THE INVENTION

Figure 1:
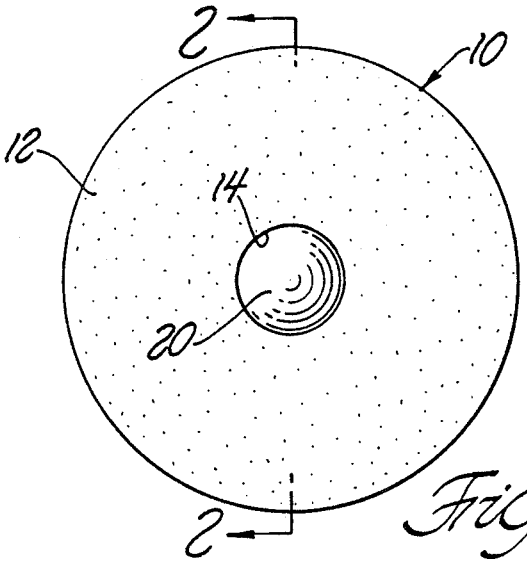
FIG. 1 is a plan view of one modification of applicant's hand exercise device.

Referring to FIG. 1 of the drawings, a hand exercise device is indicated generally at 10 and includes a resilient or elastomeric body 12. Body 12 may be formed of any suitable elastomeric or rubber-like material such as a closed cell urethane foam. The durometer of such material will be selected to provide a material which is readily compressible and that will endure repeated use.

It has been found to be most satisfactory to utilize body 12 which was a shape and size which approximates that of a hockey puck. Put in other terms, body 12 is a truncated cylinder wherein the height or thickness of the cylinder is less than the cylinder diameter. In practice, a most convenient size is a body diameter of about 3" and a thickness of about ¾" to 1". Such relationship when combined with a resilient material of a suitable density gives a device which does not collapse but, rather, compresses during use.

Figure 2:
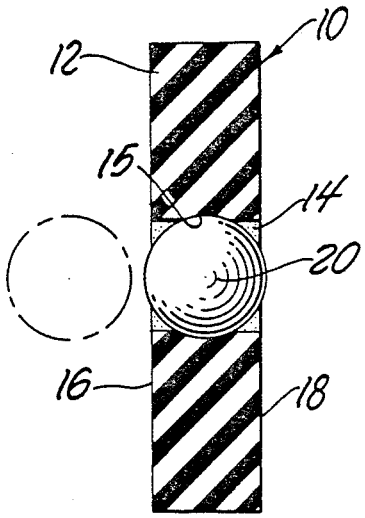
FIG. 2 is a view along line 2—2 of FIG. 1.

Referring again to FIGS. 1 and 2 of the drawings, a central recess or opening 14 is formed through body 12 such that the opening terminates in the planar faces 16 and 18 of the body. A ball member 20 may be inserted within the opening 14 from either face of the body and is slightly larger than the recess diameter. Opening 14 is molded or otherwise formed to provide a spherical pocket 15 of approximately the same diameter as ball member 20 and by virtue of which the ball is resiliently retained in the pocket. While the diameter of ball 20 may be less than the width of body 12, it is preferred that such diameter be greater than such width, as shown in FIG. 2, whereby ball 20 projects beyond planar faces 16 and 18. Member 20 is formed as a spherical or ball-like member and is relatively rigid compared to the material of body 12. While shown as a rigid ball, it is to be understood that member 20 could be of a variety of shapes and could have itself a resilient character. In fact, a series of inserts 20 can be provided which progress through various resiliencies up to a rigid member as shown. In this way a user could gradually increase the stiffness of device 10.

Figure 3:
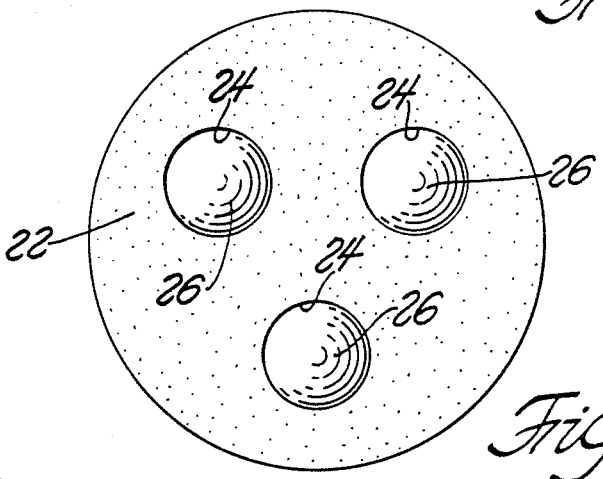
FIG. 3 is a plan view of a second modification of applicant's device.

As depicted in the modification of FIG. 3, a resilient body 22 can include a plurality of recesses or holes 24 extending therethrough and adapted each to receive suitable insertable members 26. Referring to this modification, it can be illustrated how a user would progressively increase the resistance to compression for resilient body 22. The user could begin his exercises with all of the recesses or holes 24 empty to thereby provide maximum resilience for body 22. As the hand became strengthened, the user could then progressively add insertable members 26 one by one until all the holes were filled providing progressively greater resistance to compression.

Figure 4:
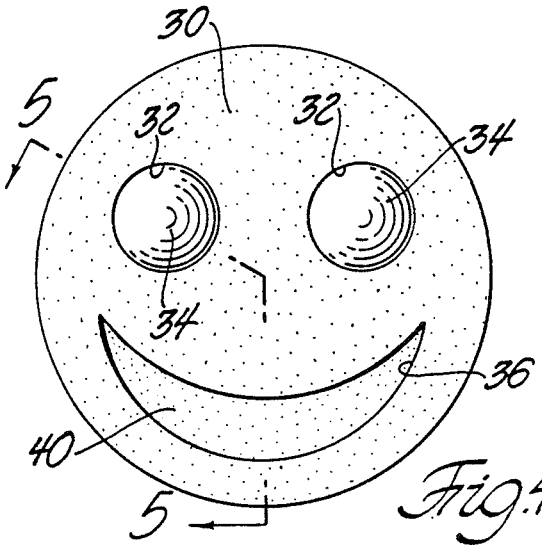
FIG. 4 is a third modification of applicant's invention.
Figure 5:
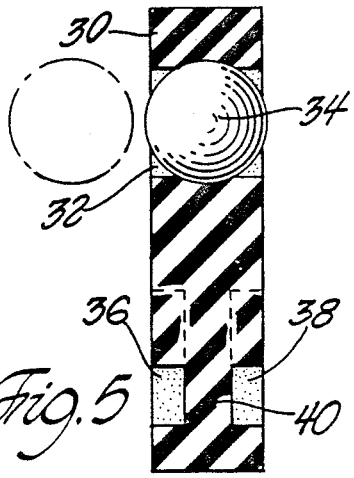
FIG. 5 is a view along line 5—5 of FIG. 4.

A final modification of the invention is depicted in FIGS. 4 and 5 wherein resilient body 30 includes a pair of recesses or through holes 32 adapted to receive suitable insertable members 34. Each of the recesses or holes 32 includes a spherical pocket 35 for retaining purposes as described with regard to pocket 15 in the modification shown in FIG. 2.

In this modification, a pair of matched recesses 36 and 38 are provided in spaced relationship to holes 32. Recesses 36 and 38 do not extend through the thickness of resilient body 30 but rather are separated by a body portion 40. The recesses 36 and 38 are utilized simply to reduce the force necessary to compress the body 30 in the area of the recesses. Thus, in this modification the hand exercise device includes a combination of through holes 32 into which suitable insertable members 34 may be located along with recesses 36 and 38 adapted to permanently soften a particular area of the device.

It is apparent that other modifications may be made within the scope of the hereinafter appended claims.

What is claimed is:

1. A hand exercising device of the type including a resilient body of a size and shape to fit within the palm area of a user's hand, said body being formed of a homogeneous and readily compressible material, said body including recess means formed therein to alter the compressibility of the body, the improvement comprising:

a. said resilient body formed in the shape of a truncated cylinder wherein the cylinder height is less than its diameter;

b. said recess means including a plurality of circular openings extending through said body and terminating in each planar face thereof;

c. a ball member removably insertable within each opening to alter the compressibility of said device; and d. each opening including a spherical pocket for resiliently retaining said ball and the diameter of said ball being greater than the height of the resilient body whereby the ball partially projects beyond each planar face of said body.

* * * * *